US005160692A

United States Patent [19]

Daussan et al.

[11] Patent Number: 5,160,692

[45] Date of Patent: Nov. 3, 1992

[54] PROCESS AND PLANT FOR PRODUCING A LINING ON THE INNER WALLS OF A METALLURGICAL VESSEL

[75] Inventors: Jean-Charles Daussan, Metz; Gérard Daussan; André Daussan, both of Longeville-les-Metz, all of France

[73] Assignee: Daussan et Compagnie, Woippy, France

[21] Appl. No.: 623,907

[22] PCT Filed: Apr. 25, 1990

[86] PCT No.: PCT/FR90/00297

§ 371 Date: Dec. 21, 1990

§ 102(e) Date: Dec. 21, 1990

[87] PCT Pub. No.: WO90/12666

PCT Pub. Date: Nov. 1, 1990

[30] Foreign Application Priority Data

Apr. 26, 1989 [FR] France ..... 89 05528

[51] Int. Cl.[5] ..... B22D 41/02

[52] U.S. Cl. ..... 266/44; 266/281; 264/30

[58] Field of Search ..... 266/44, 280, 281, 286; 264/30

[56] References Cited

U.S. PATENT DOCUMENTS 4,696,455 9/1987 Johnson ..... 266/280

FOREIGN PATENT DOCUMENTS 0105795 8/1985 European Pat. Off. .
0214882 3/1987 European Pat. Off. .
0289480 11/1988 European Pat. Off. .
2363776 7/1974 Fed. Rep. of Germany ..... 266/281
2018181 5/1970 France .

*Primary Examiner*—Scott Kastler
*Attorney, Agent, or Firm*—Young & Thompson

[57] ABSTRACT

A metallurgical vessel (1) whose inner walls to be lined are relatively hot is placed on a suitable support; the support is tilted and the metallurgical vessel (1) is brought successively into a number of different positions, in each of which an inner wall or a part of wall of the vessel is substantially horizontal and turned upwards; in each of the abovementioned positions at least one layer of a substantially dry material comprising a mixture of refractory particles and a binder of the thermosetting or equivalent type is spread on the inner wall or part of wall, the composition and the particle size range of the mixture of refractory particles being such that this mixture sinters in contact with the liquid metal, and this material is spread out so as to form a substantially uniform layer, the inner walls of the vessel being initially at a sufficient temperature to be able to heat the material deposited on them to a temperature permitting the softening and the setting of the binder of thermosetting or equivalent type and the formation of a monolithic lining (5) which adheres to the inner walls of the vessel. Use especially for producing a lining on the inner walls of a metallurgical vessel.

18 Claims, 3 Drawing Sheets

PROCESS AND PLANT FOR PRODUCING A LINING ON THE INNER WALLS OF A METALLURGICAL VESSEL

The present invention relates to a process for producing a lining on the inner walls of a metallurgical vessel intended to receive liquid metal.

The present invention also relates to a plant for making use of the abovementioned process.

A number of processes for producing a lining on the inner walls of a metallurgical vessel are known.

Thus, for example, there is known, according to the Applicant Company's French Patent 2,393,637, a process in which an aqueous and pasty mixture capable of setting, containing inorganic particles, optionally fibres, and an organic and/or inorganic binder, is applied by moulding, tamping or projecting with the trowel or pneumatic or other projecting to the inside of a metallurgical vessel such as a casting tundish. The mixture of particles sinters in contact with the liquid metal, and this ensures the cohesion of the lining.

According to French Patent Applications 2,585,273, 2,613,256 or 2,619,323 in the name of the Applicant Company there is also known a process according to which at least two layers of different compositions are applied to the inside of the metallurgical vessel, each being applied by projecting an aqueous and pasty mixture capable of setting of the abovementioned type.

These processes, which otherwise give the users complete satisfaction, nevertheless present a disadvantage: at least all the wetting water employed for forming the aqueous mixture(s) must be removed by drying, and this involves an immobilization time and an expenditure of energy, neither of which can be ignored.

There is also known a process according to which a template is placed inside a metallurgical vessel, a material consisting of refractory particles and of a heat-curable binder is projected pneumatically between the template and the inner walls of the vessel, and heating is then applied while the template is left in place to cause the binder to set, and the template is finally removed. The cast material contains an inorganic compound containing water of crystallization.

According to other known processes requiring the use of a template, the material of the abovementioned type is compacted between the template and the inner walls of the vessel, either by tamping or by vibration or by impacts.

The use of a template, which in some cases must be left in place, always causes a loss of time and is a source of expenditure due to the handling and the adjustments which it requires.

Moreover, heating the material through the template represents a certain consumption of energy and an additional time of immobilization of the metallurgical vessel.

Finally, if the material is deposited onto a permanent protective lining which is already worn, the use of a template which imposes a uniform outer profile of the lining results in the installing of a layer of material whose thickness is greater than that necessary, and this causes an excessive and useless consumption of this material.

The aim of the present invention is to overcome the disadvantages of the known processes and to propose a process which is simple, rapid and economical to employ and which is particularly well suited to the production of the wear lining of a metallurgical vessel.

The aim of the present invention is also to propose a plant for making use of the said process.

According to the invention the process for producing a lining on the inner walls of a metallurgical vessel intended to receive liquid metal is characterized in that it comprises the following stages:

a) a metallurgical vessel whose inner walls to be lined are relatively hot is placed on a suitable support;

b) the support is tilted and the metallurgical vessel is brought successively into a number of different positions, in each of which an inner wall or a part of wall of the vessel is substantially horizontal and turned upwards;

c) in each of the abovementioned positions at least one layer of a substantially dry material comprising a mixture of refractory particles and a binder of the thermosetting or equivalent type is spread on the said inner wall or part of wall, the composition and the particle size range of the mixture of refractory particles being such that this mixture sinters in contact with the liquid metal, and this material is spread out so as to form a substantially uniform layer;

d) the inner walls of the vessel being initially at a sufficient temperature to be able to heat the material deposited on them to a temperature permitting the softening and the setting of the binder of the thermosetting or equivalent type and thus to form a monolithic lining which adheres to the inner walls of the vessel.

A substantially dry material can thus be employed without having to be mixed with water to form an aqueous mixture and without the lining then having to be dried in place to remove this water.

Given that the walls and the bottom of the vessel are initially at a sufficient temperature to make it possible to heat the deposited lining to a temperature making it possible to cause the softening and the setting of the binder of the thermosetting type, the newly spread material forms, with the material deposited previously, a monolithic lining which adheres to the wall on which it is spread.

As soon as the wall or part of wall to be lined has been lined, it is therefore possible to change the position of the metallurgical vessel to line another wall or part of wall or even to turn the vessel by 180° to line the wall opposite that lined, without running the risk of unbonding the deposited lining from the latter, or of causing the fall of the refractory particles which are not yet bonded to the latter.

The installation of the lining can therefore be carried out very rapidly, without the aid of a template and without the need for compacting the material.

Furthermore, since the deposited material is substantially dry, no drying is necessary and, when the quality of the steel which is poured does not require the removal of the water of crystallization and/or of certain gases which the lining may contain, the metallurgical vessel is therefore practically immediately brought back into the use circuit, and this permits a very rapid rotation cycle of the latter.

Moreover, the process makes it possible to deposit a layer of determined thickness: if a consumable layer is deposited on a partially worn permanent lining, it is possible to follow the outer surface of the latter and to avoid any unnecessary excess of material.

According to a preferred version of the invention, the lining obtained is insulating and refractory.

In most cases the metallurgical vessel can therefore be employed without any prior preheating without the risk that liquid metal cooled in contact with the walls sets against the latter, and it is thus possible to obtain a saving of time and of the heat energy required for this preheating.

According to another aspect of the present invention, the plant for producing a lining on the inner walls of a metallurgical vessel intended to receive a liquid metal, by making use of the abovementioned process, is characterized in that it comprises:

means for preparing or receiving a substantially dry material comprising a mixture of refractory particles and a binder of the heat-curable or equivalent type, the composition and the particle size range of the mixture of particles being such that this mixture sinters in contact with the liquid metal;

support means for receiving a metallurgical vessel whose inner walls are relatively hot;

means for tilting the support and for bringing the metallurgical vessel successively into a number of different positions, in each of which an inner wall or a part of wall of the vessel is substantially horizontal and turned upwards;

means for spreading, in each of the abovementioned positions, at least one layer of the said substantially dry material on the said inner wall or part of wall and spreading out this material so as to form a substantially uniform layer.

As indicated above, this plant makes it possible to produce, in most cases, without a template, a lining which does not require any drying before the vessel is brought back into service, and the newly spread material forms with the material already in place a monolithic block which adheres to the wall.

Other characteristics and advantages of the invention will appear further in the detailed description below.

BRIEF DESCRIPTION OF THE DRAWINGS

In the attached drawings, which are given by way of examples without any limitation being implied.

Figure 1:
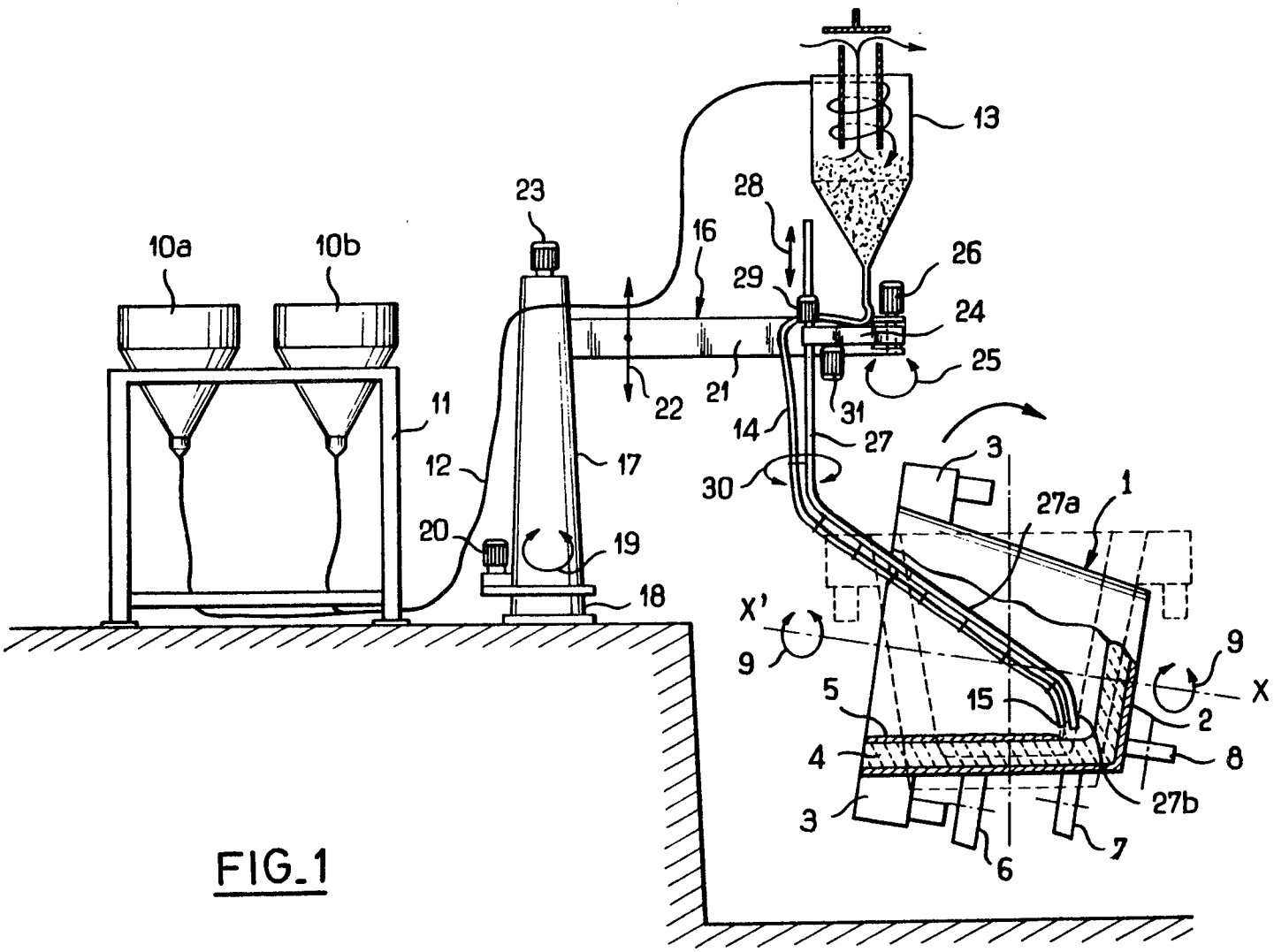
FIG. 1 is a diagram with cutaway of a plant according to a first embodiment of the invention and comprising a robot for lining a pouring ladle.

In the embodiment shown in FIG. 1, the plant in accordance with the invention is adapted for lining the inner walls of a pouring ladle 1 whose jacket 2, equipped with lugs 3 is lined internally with a permanent refractory lining 4, made of shaped bricks or refractory concrete.

This permanent refractory lining 4 must be covered with a wear lining 5 deposited on the bottom and the inner side walls of the pouring ladle 1 and intended to be in contact with the liquid metal.

The pouring ladle 1 is placed on a tilting support (not shown) known per se. This tilting support can receive the ladle 1 in the position shown in dash lines in the figure, in which the bottom of the ladle 1 is substantially horizontal. The support can also tilt the ladle 1 into the position shown using full lines, in which the lowest part of the inner wall of the ladle is substantially horizontal and turned upwards.

The tilting support comprises means, known per se and shown diagrammatically by rollers 6, 7, 8, for rotating the ladle 1 around its axis X, X, in this tilted position, as shown diagrammatically by the arrows 9.

The plant comprises means for preparing or receiving and conveying a substantially dry material intended to be spread to form the wear lining 5.

In the example shown diagrammatically in the figure, these means consist of two hoppers 10*a*, 10*b* which are mounted on a framework 11 and adapted to receive, in bags (not shown) or by a conveyor, for example a belt conveyor (not shown), the substantially dry mixture to be deposited. In a known manner, these hoppers 10*a*, 10*b* can be alternately closed and pressurized with compressed air for the material to be pneumatically conveyed by a flexible conduit 12 to a cyclone separator 13 which separates the material to be deposited from the conveying air. The material can thus be routed without pressure merely by gravity into a flexible conduit 14 down to the deposition point 15 which can be equipped with a valve (not shown).

In the example shown, the cyclone separator 13 and the flexible conduit 14 are carried by a robot 16.

The robot 16 comprises a substantially vertical shaft 17 movable in rotation around its axis relative to a stationary base 18 and driven in rotation in either direction, as shown by the arrow 19, by a motor 20.

A substantially horizontal arm 21 carried by the shaft 17 can move vertically (arrow 22) along the shaft 17 under the effect of a motor 23. The cyclone separator 13 is carried by the arm 21.

A second substantially horizontal arm 24 is jointed at one of its ends to the end of the arm 21 and can pivot in a horizontal plane around the end of the arm 21 (arrow 25) under the effect of a motor 26.

The other end of the arm 24 supports a substantially vertical mast 27 which can move vertically (arrow 28) under the effect of a first motor 29, and which can turn around its axis (arrow 30) under the effect of a second motor 31.

The mast 27 is extended downwards by a part 27*a* which extends obliquely and which ends in a substantially vertical part 27*b*. The flexible conduit 14 is secured along the mast 27, the deposition point 15 of this conduit being adjacent to the lower end of the part 27*b* of the mast 27. The diameter of this flexible conduit 14 is sufficient to permit a satisfactory flow of the material under gravity without risk of blocking.

The robot 16 also comprises means, not shown, for coordinating the delivery of the material, the movements of the components of which it is made up and the movements of the ladle on the tilting support.

Figure 2:
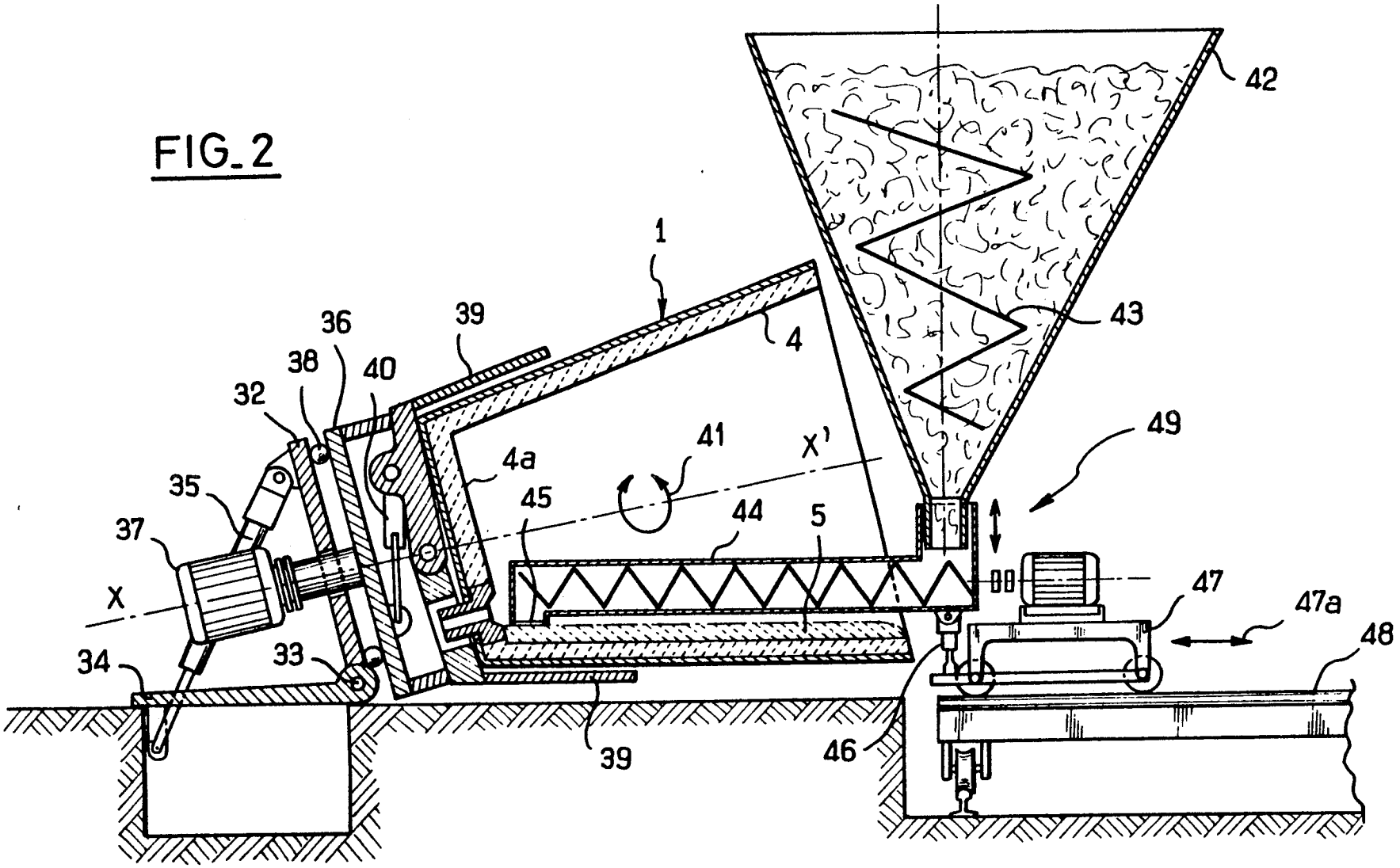
FIG. 2 is a partially cross-sectional diagram of a plant according to another embodiment of the invention for lining a pouring ladle.

In the embodiment shown diagrammatically in FIG. 2, the plant in accordance with the invention comprises a tilting support 32 capable of pivoting around an axis 33 relative to a stationary structure 34 under the effect of a pivoting jack 35.

The tilting support 32 carries a rotating tray 36 capable of rotating relative to the support 32 under the effect of a motor 37 by means of any known means symbolized by balls 38. The rotating tray 36 is intended to receive a pouring ladle 1 attached to the rotating tray 36 by means of clamps 39 actuated by a jack 40, so as to make the ladle 1 rotate around its axis X, X' (arrow 41).

In the tilted position of the support 32, shown in the figure, the lowest part of the inner wall of the ladle 1 is substantially horizontal.

The material to be spread is stored in a hopper 42 which is, for example, of conical shape, inside which a mixing screw 43 driven by a motor, not shown, is rotating. In the lower part of the hopper 42, the material falls into a conveyor screw 44, at the delivery end 45 of which the material is deposited onto the inner wall of the ladle 1.

The screw 44 is shown mounted on a jack 46 which makes it possible to make it fit over the lower part of the hopper 42 and to uncouple it from the latter, this lower part of the hopper being then closed by a valve, not shown.

The hopper 42 and the conveyor screw 44 are mounted on a trolley 47 which can move along the arrow 47*a* in the axial direction of the screw 44 to make it possible to spread the material along a generatrice of the inner wall of the ladle 1. The trolley 47 itself is mounted on a framework 48 which can, for example, move in the direction perpendicular to the direction of travel of the trolley 47. The whole forms a robot 49 equipped with means, not shown, for coordinating the delivery of the material with the movements of the ladle 1 and those of the trolley 47. The bottom 4*a* of the ladle can be lined in a manner which is identical with that described with reference to FIG. 1, this bottom being in a horizontal position and the lining material being deposited onto this bottom, for example by means of a tubular spout which can move over the whole surface of the said bottom.

In the embodiment shown diagrammatically in FIGS. 3, 4A, 4B and 4C, a continuous casting tundish 50 is mounted on a tilting framework 51 of any known type in the vicinity, for example, of the robot 16 with jointed arms which was described above with reference to FIG. 1.

Figure 3:
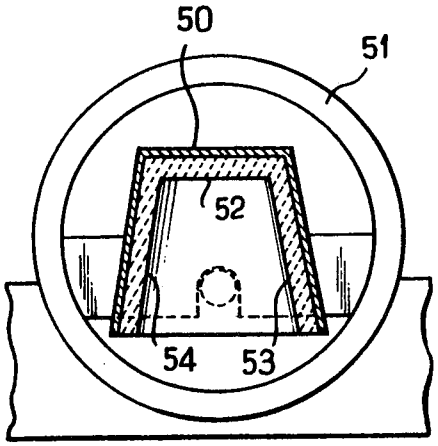
FIG. 3 is a partial cross-sectional diagrammatic view of a continuous casting tundish placed in a tilter near the robot of FIG. 1, the tilter being in the upside down position.

The tundish 50 is shown in FIG. 3 in the upside down position which makes it possible to drop the worn wear lining and "scraps" of metal and/or of slag which are attached to the latter, for example into a rubbish skip (not shown).

Figure 4A:
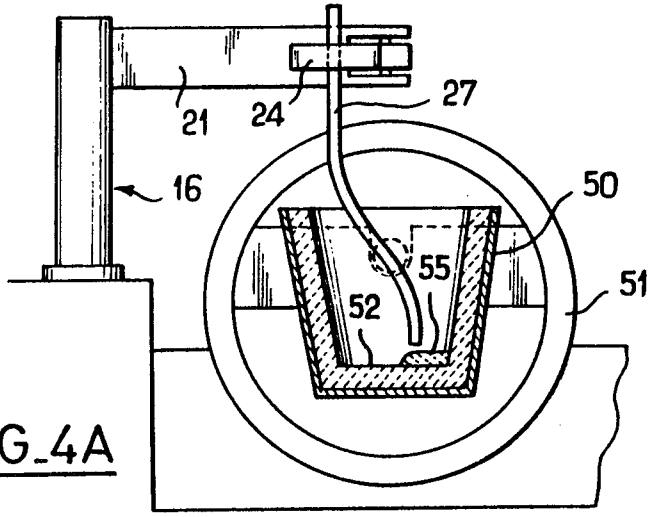
FIGS. 4A, 4B and 4C are views similar to FIG. 3, the tundish being in a normal position, in a position tilted to the left and in a position tilted to the right respectively, for depositing the lining on the bottom and on each of the two lengthwise side walls respectively.

In FIG. 4A the tundish 50 is shown in the normal position of use; the horizontal arms 21 and 24 are deployed and the mast 27 is oriented so as to make it possible to form the lining on the bottom 52 of the tundish 50. The flexible conduit 14 is not shown, to make the drawing clearer.

Figure 4C:
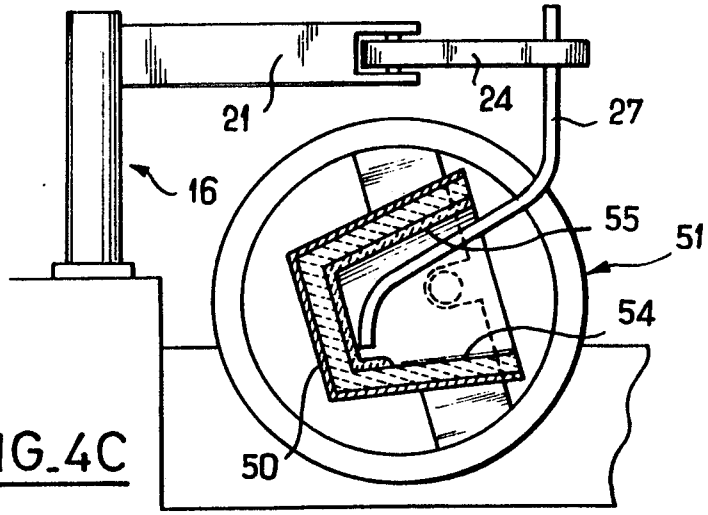
Figure 4B:
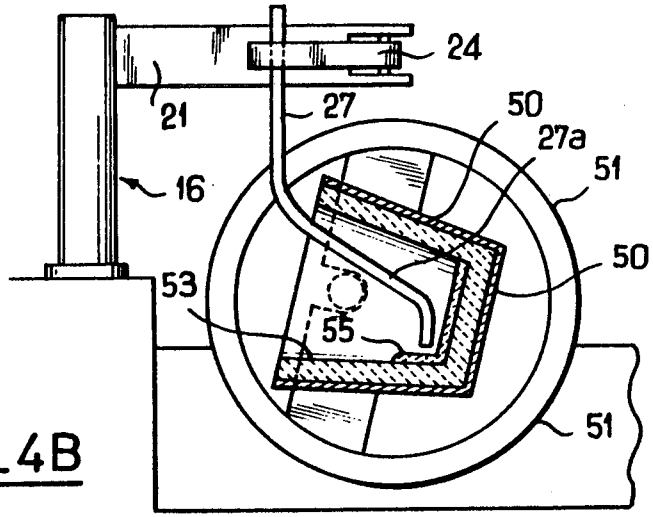

In FIG. 4B the tundish 50 is shown in the position which is tilted towards the left of the figure, in which the lengthwise side wall 53 is substantially in a horizontal position: the cranked part 27*a* can thus enter the inside of the tundish to spread the material over the whole surface of the wall 53 and thus to form the lining 55.

Similarly, in FIG. 4C, the distributor 50 is tilted towards the right and the jointed arm 24 is deployed so as to allow the deposition of the material on the wall 54 and the formation of the lining 55.

Whatever the metallurgical vessel and the plant employed for making use of the invention, the material forming the wear lining 5, 55, is a substantially dry material comprising a mixture of refractory particles and a binder of the heat-curable or equivalent type, the composition and the particle size range of the mixture of refractory particles being such that this mixture sinters in contact with the liquid metal.

Furthermore, this material is intended to be spread on the inner walls of a metallurgical vessel which are initially at a sufficient temperature to be able to heat the material deposited on them to a temperture permitting the softening and the setting of the binder of the thermosetting or equivalent type and the formation of a monolithic lining which adheres to these inner walls of the vessel 1, 50.

The refractory particles may be chosen, for example, from the group comprising particles based on magnesia, silicomagnesia, silicoalumina, alumina, silica, calcium carbonate, lime, dolomite, carbon, chromium oxide, zircon and mixtures thereof. These particles may be in the form of grains, powders and/or fibres.

It is possible to choose the binder of the heat-curable or equivalent type, for example, from the group comprising natural and synthetic thermosetting resins such as, for example, phenol-formaldehyde resins, ureaformaldehyde resins, polyvinyl resins, and the like, inorganic binders of the thermosetting or equivalent type softening on heating such as, for example, sodium silicate (which dissolves in the region of 70° C.), metasilicate, and the like, organic binders and/or agglutinants such as, for example, starch, starch flour, stearate, carboxymethyl cellulose, and the like, and mixtures of these compounds.

The refractory particles may be merely mixed with the particles of the binder of the thermosettng type. In some cases the refractory particles may be coated with the binder, for example if highly hygroscopic particles are employed, such as dolomite particles, which tend to absorb moisture.

The spread mixture is preferably a refractory insulant and is made up of particles whose particle size range is studied so as to endow the coating in place after sintering in contact with the liquid metal with a total porosity which is higher than 45%; this insulating nature of the lining limits the cooling of the liquid metal in contact with the walls of the metallurgical vessel, and this makes it possible to dispense with preheating the walls of the vessel before use, without a risk of solidification of metal in contact with these walls.

The spread mixture may have a general composition of the following type:

| | |
|---|---|
| Refractory particles in the form of grains and/or powders: | 80 to 100% |
| Organic and/or mineral fibres: | 0 to 10% |
| Binder: | 0 to 10% |

The following compositions of mixtures of different natures, in which the binder appears under the heading "loss on ignition", can also be given by way of nonlimiting examples:

| | |
|---|---|
| Siliceous refractory insulating material | |
| $SiO_2$ | 80 to 96% |
| $Al_2O_3$ | 6 to 0% |
| Loss on ignition | 0.5 to 8% |
| Alkali metal salts | 0 to 5% |
| Magnesia refractory insulating material | |
| MgO | 68 to 83.5% |
| $Cr_2O_3$ | 8 to 0% |
| Chamotte | 4 to 0% |
| $Al_2O_3$ | 2.8 to 0% |
| $SiO_2$ | 0 to 8% |
| Iron oxide | 0.2 to 8% |
| Alkali metal salts | 5 to 0% |
| Loss on ignition | 8 to 0.5% |

-continued

| Purifying refractory insulating material | |
|---|---|
| $SiO_2$ | 0 to 6% |
| $Al_2O_3$ | 5 to 0% |
| CaO | 20 to 80% |
| MgO | 80 to 20% |
| Iron oxide | 0.8 to 8% |
| B | 0 to 4% |
| Loss on ignition | 0.5 to 4% |

The application of the process of the invention when using one or other of the plants described above is extremely simple:

a) a metallurgical vessel 1, 50, whose inner walls to be lined are relatively hot is placed on a suitable support;

b) the support is tilted and the metallurgical vessel 1, 50 is brought successively into a number of different positions in each of which an inner wall or a part of wall of the vessel is substantially horizontal and turned upwards;

c) in each of the abovementioned positions at least one layer of a substantially dry material comprising a mixture of refractory particles and a binder of the thermosetting or equivalent type is spread on the said inner wall or part of wall, the composition and the particle size range of the mixture of refractory particles being such that this mixture sinters in contact with the liquid metal, and this material is spread out so as to form a substantially uniform layer;

d) the inner walls of the vessel being initially at a sufficient temperature to be able to heat the material deposited on them to a temperature permitting the setting of the binder of the thermosetting or equivalent type and the formation of a monolithic lining 5, 55 which adheres to the inner walls of the vessel.

The permanent inner lining can thus be at a temperature ranging from approximately 250° C. to approximately 400° C.; it is thus possible to reline a vessel shortly after its use.

If a vessel whose walls are cold is to be relined, one begins by reheating these to the required temperature with any known means, for example a gas burner or an infrared rack.

Some walls may not be accessible to the means described above and are lined in any known manner, automatically or by hand.

Thus, for example, in the case of an elongate metallurgical vessel such as a continuous pouring tundish it is not easy to bring the transverse side walls into a horizontal position to enable the lining material to be deposited.

It is simpler to install a small partial template, temporary or sacrificial, and to deposit the lining material between this template and the inner wall to be lined. Alternatively, it is also possible to prepare and install a preformed lining panel made of the same material.

It is obviously possible to provide for spreading a lining made up of two or more layers of different compositions and characteristics, applied successively, and, for example, to spread out against the permanent lining a layer which does not sinter or which sinters only slightly so as to make it easier to separate the wear lining after use without any risk of bonding to the permanent lining.

In all cases the tap hole is temporarily shut off during the deposition of the lining.

Given the temperature of the inner walls of the vessel, as soon as the material is spread, the binder softens and becomes adhesive, and this allows the material to be adhesively bonded to the inner walls and to form on the latter a lining which is monolithic with the material already in place. The vessel can be thus moved quickly and even tilted through nearly 180° to line a wall opposite that already lined without the risk of making fall the lining already in place.

The stage of heating the template of the known processes described above can thus be dispensed with. Since the material is substantially dry, it is also unnecessary, in most cases, to perform the drying which is needed with the processes employing aqueous mixtures. On the other hand, if the grade of the steel which is poured requires the removal of water of crystallization and/or of harmful gases liable to be released in contact with the liquid metal, it remains necessary to heat the lining to remove this water and these gases.

When liquid metal is subsequently poured into the vessel which is lined as described above, it is known that the binder disappears rapidly, but the cohesion of the lining in place is ensured by the sintering of the material in contact with the liquid metal.

From the above it will be understood that the process and the plant in accordance with the invention relate very particularly to metallurgical vessels for transfering such as pouring ladles, slag pots or continuous casting tundishes.

The invention is obviously not limited to the embodiments just described, and numerous changes and modifications can be made to the latter without departing from the scope of the invention.

Thus, the means employed for storing, conveying and spreading the lining material may be different from those described for example, instead of the alternately pressurized hoppers 10 it is possible to use a projecting machine of the cylinder barrel type, suitable for conveying pulverulent materials which may contain fibres and, more generally, any combination of known means of conveying and of handling capable of routing the material to be spread over the entire inner wall or part of wall to be lined. Instead of the cyclone separator 13 it is possible to employ any apparatus allowing the material to be spread to be separated from the conveying compressed air. It is also possible to employ any combination of conveyors, conveyor screws, spouts or flexible conduits to direct the product and to mount these pieces of apparatus on trolleys and frameworks of various types making it possible to move the orifice for depositing the product over the whole inner wall or part of wall to be lined.

It is also possible to employ a robot 16 of a type other than that described, for example a robot whose base may be movable in translation in the direction of the lengthwise axis of a continuous casting tundish, or a robot comprising a gantry instead of the jointed arms described.

It is also possible to employ the process and the plant in accordance with the invention for forming the permanent refractory lining for protecting a metallurgical vessel, the composition and the particle size range of the mixture of particles employed being adapted to a use of this kind.

We claim:

1. Process for producing a lining (5, 55) on the inner walls of a metallurgical vessel (1, 50) adapted to receive liquid metal, comprising the following steps:

a) placing a metallurgical vessel (1, 50) whose inner walls to be lined are relatively hot on a support;

b) tilting the support and the metallurgical vessel (1, 50) to bring the vessel successively into a number of different positions, in each of which at least a part of an inner wall of the vessel (1, 50) is substantially horizontal and turned upwards;

c) in each of the abovementioned positions depositing at least one substantially uniform layer of a substantially dry material comprising a mixture of refractory particles and a binder capable of setting when heated, on the said substantially horizontal inner wall, the composition and the particle size range of the mixture of refractory particles being such that this mixture sinters in contact with the liquid metal;

d) the inner walls of the vessel being initially at a sufficient temperature to be able to heat the material deposited on them to a temperature permitting the softening and the setting of the binder of said material and the formation of a monolithic lining (5, 55) which adheres to the inner walls of the vessel (1, 50).

2. Process according to claim 1, wherein, on certain walls of small dimensions which cannot be placed in a substantially horizontal position, the same material is installed either in the form of preformed panels or by employing partial templates behind which the material is spread.

3. Process according to claim 1 wherein at least two layers of different compositions and characteristics are applied successively.

4. Process according to claim 1 wherein the refractory particles are chosen from the group consisting of particles based on magnesia, silicomagnesia, silicoalumina, alumina, silica, calcium carbonate, lime, dolomite, carbon, chromium oxide, zircon, and mixtures thereof.

5. Process according to claim 1, wherein said binder is chosen from the group consisting of natural and synthetic thermosetting resins, inorganic binders softening on heating and thus becoming adhesive, organic binders or agglutinants, and mixtures of these compounds.

6. Process according to claim 1 wherein the refractory particles are mixed with particles of said binder.

7. Process according to claim 1 wherein the refractory particles are coated with said binder.

8. Process according to claim 1 wherein the lining obtained is a refractory insulant.

9. Process according to claim 1, said metallurgical vessel being a ladle having an inner lateral wall which is a figure of revolution about an axis, tilting said ladle until said axis is inclined at an acute angle to the horizontal and a portion of said inner lateral wall is substantially horizontal, and thereafter rotating the ladle about said axis while applying said material until said inner lateral wall is entirely covered.

10. Plant for producing a lining (5, 55) on inner walls of a metallurgical vessel (1, 50) adapted to receive a liquid metal, comprising means for dispensing by gravity a substantially dry material comprising a mixture of refractory particles and a binder capable of setting when heated, the composition and particle size range of the mixture of refractory particles being such that this mixture sinters in contact with the liquid metal;

support means for receiving a said metallurgical vessel (1, 50) whose inner walls are relatively hot;

means for tilting the support means and for bringing the metallurgical vessel (1, 50) successively into a number of different positions, in each of which at least a part of an inner wall of the vessel is substantially horizontal and turned upward, thereby to receive by gravity from said dispensing means on said substantially horizontal wall a substantially uniform layer of said material.

11. Plant according to claim 10, wherein said support means is adapted to assume an upside down position in which the metallurgical vessel is turned through 180° relative to its normal position of use.

12. Plant according to claim 10, the metallurgical vessel being an elongated continuous casting tundish, wherein said support means is adapted to tilt said tundish at least about a horizontal axis parallel to a lengthwise axis of the elongated tundish in two orthogonal horizontal directions.

13. Plant according to claim 10, the metallurgical vessel being a pouring ladle having an inner side wall which is a figure of rotation about an axis, the support means being adapted to tilt the lade about a horizontal axis into a position in which the lowest portion of said inner side wall of the ladle is substantially horizontal, and means for thereafter rotating the ladle about said ladle axis.

14. Plant according to claim 10, and means mounting said dispensing means for movement about two vertical horizontally-spaced axes of revolution.

15. Plant according to claim 14, and means for bodily vertically moving said dispensing means along at least one of said vertical axes.

16. Plant according to claim 14, and means for bodily vertically moving said dispensing means selectively individually along both of said vertical axes.

17. Plant according to claim 16, and means for swinging said dispensing means horizontally selectively about a third vertical axis spaced from the first-mentioned vertical axes.

18. Plant according to claim 10, and means for swinging said dispensing means horizontally selectively about three horizontally-spaced vertical axes.

* * * * *